US006199731B1

(12) United States Patent
Lehoux

(10) Patent No.: US 6,199,731 B1
(45) Date of Patent: Mar. 13, 2001

(54) DOUBLE STRAP HARNESS FOR A GUITAR

(76) Inventor: Randy A. Lehoux, 146 A Jaggar Rd., Sanford, ME (US) 04073

( * ) Notice: Subject to any disclaimer, the term of this patent is extended or adjusted under 35 U.S.C. 154(b) by 0 days.

(21) Appl. No.: 09/363,812

(22) Filed: Jul. 30, 1999

(51) Int. Cl.[7] ..... A45F 3/04

(52) U.S. Cl. ..... 224/260; 224/259; 224/910; 84/327

(58) Field of Search ..... 224/259, 260, 224/910, 264; 84/327

(56) References Cited

U.S. PATENT DOCUMENTS 1,879,480 * 9/1932 Pures ..... 224/260
2,477,432 * 7/1949 Walsh ..... 224/260
4,930,695 * 6/1990 Thompson et al. ..... 224/910
5,961,014 * 10/1999 Knerr ..... 224/259

* cited by examiner

*Primary Examiner*—Stephen K. Cronin
(74) *Attorney, Agent, or Firm*—William F. Hamrock

(57) ABSTRACT

A double strap harness having right and left shoulder strap systems and a back connecting system for supporting and positioning a guitar or similar instrument in front of a player. The right shoulder strap system extends over the right shoulder and is mounted on the strumming end of the guitar. The left shoulder strap system includes two straps extending over the left shoulder mounted to the front and back of the player, and a strap mounted on the fret end of the guitar. The back connecting system ties the right and left strap systems together. Each system performs its own weight managing function allowing the distribution support to coincide with the actions of the player.

12 Claims, 3 Drawing Sheets

DOUBLE STRAP HARNESS FOR A GUITAR

BACKGROUND OF THE INVENTION

The present invention relates to supporting and positioning a guitar or similar instrument, hereinafter referred to as the guitar, by allowing the player to control the amount of weight applied to each shoulder and to comfortably direct the angle and height of the guitar.

The weight of a guitar is very heavy and uncomfortable to hold over long periods of time. Various suspension systems for supporting the guitar on the front of the body have been used. A type of suspension strap commonly used is a single strap slung over one shoulder. However the strap rests on very sensitive muscles close to the player's neck. Within a short period of time, the player develops fatigue and discomfort. Other types offer double strap type solutions which attempt to split the weight in half and attempt to evenly distribute the weight across the shoulders or affixed to a belt but the result is that it appears to make the suspension system rigid, uncomfortable and less appropriate for guitar use.

SUMMARY OF THE INVENTION

The present inventions overcomes the deficiencies of the prior art by supporting and positioning the guitar in the front of the player with a unique harness system for each shoulder tied together by a back connecting strap. With the two independent shoulder harness systems bridged by the narrow back connecting strap which controls the amount of distance between the two shoulder systems, the player is able to control how high to raise up either side of the guitar which affords greater control over positioning of the guitar. The player is then able to adjust the guitar to the most comfortable position not previously available.

The right shoulder system includes a wide shoulder strap attached to an adjustable strap loop stretching under the arm to a connector strap which is movably attached at the bottom of the loop. The connector strap forms an adjustable loop having a movable mounting means mounted on the strumming end of the guitar. The left shoulder system includes a shoulder strap having front and rear straps attached thereto and attached to the player's waist band or belt which keeps the weight of the guitar off the sensitive neck muscles. Also connected to the left shoulder strap is a fret end connecting strap system forming a fret end strap loop having a movable mounting means mounted on the fret end of the guitar. A back connector strap system adjustably connects the right and left strap shoulder systems together. The strategic locations of the adjustable and movable connections and of the strap loops allows the positioning of the guitar in the most comfortable position.

DETAILED DESCRIPTION OF THE PREFERRED EMBODIMENT

Figure 1:
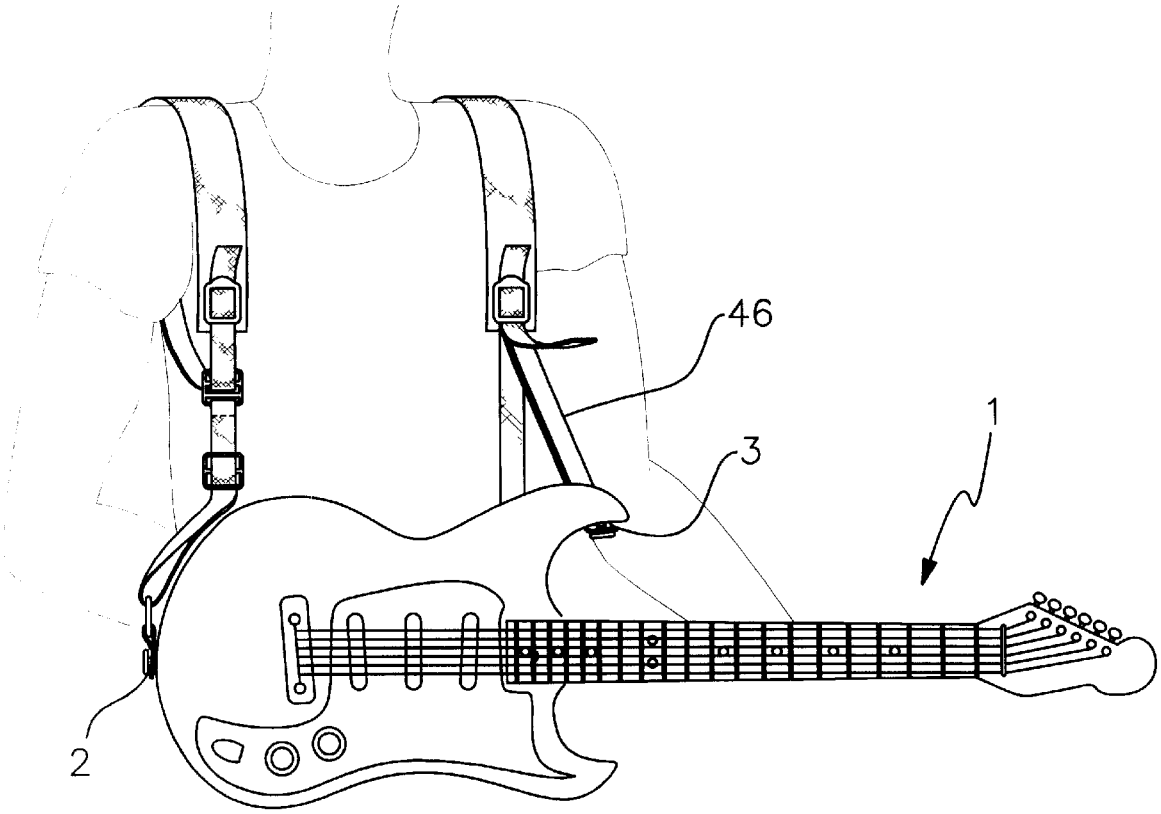
FIG. 1 is a view of a player wearing the harness of the invention supporting a guitar.

FIG. 1 illustrates a player wearing a double strap harness 10 of the invention supporting a guitar 1 at the front of the player's body. Shown are the protruding strumming end button 2 or right end button and the fret end button 3 or right end button located at opposite ends of the guitar for mounting the guitar to the double strap harness 10. Each of the guitar buttons has an enlarged head or other type of mounting means overwhich the harness straps are mounted.

Figure 2:
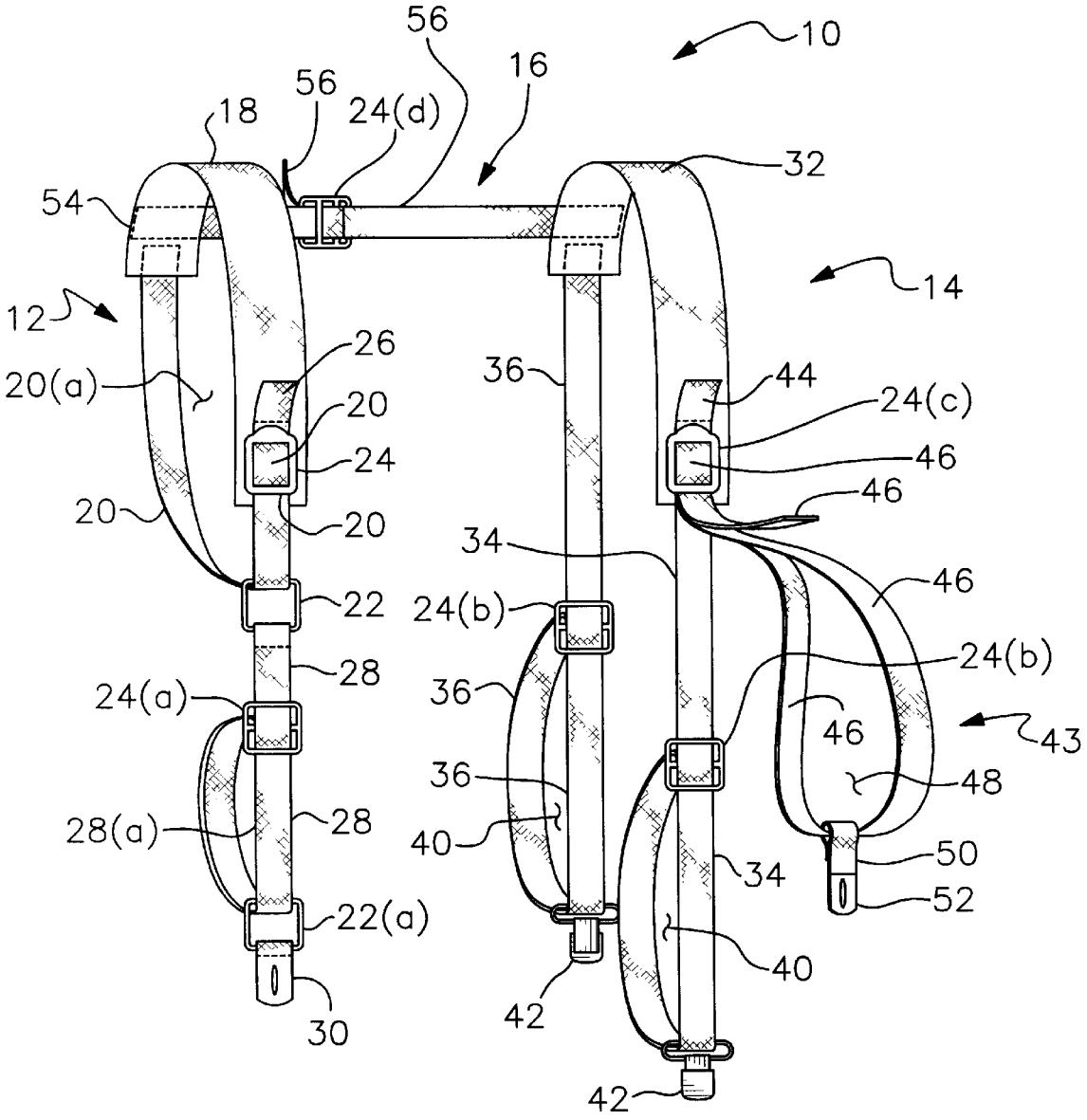
FIG. 2 is an isolated overall view of the harness of the invention.

Shown in FIG. 2 is an overall isolated view of the double strap harness 10 of the invention generally made of resilient durable harness fabric or similar material. The strap harness includes right shoulder strap system 12 connected to the strumming end of the guitar, left shoulder system 14 connected to the fret end of the guitar and back strap system 16 which bridges the two systems together. The right shoulder system 12 and left shoulder system 14 allow the player to control the amount of weight applied to each shoulder and position the angle and height of the guitar. The back connector strap system 16 controls the the distance between the independent right and left shoulder systems allowing the player to control the actual positioning of the shoulder straps for comfort.

The right shoulder system as seen in FIGS. 1 and 2 shows wide shoulder strap 18 extending over the shoulder attached at each end to narrow strap 20 stretching under the player's arm in a loop 20(*a*). This is accomplished with one end of narrow strap 20 being attached to the rear of shoulder strap 18 by sewing or other means and loops under the player's arm forming loop 20(*a*) passing through connector bracket 22 to be adjustably mounted in lenght through strap adjuster 24 at its opposite end. Short shoulder strap 26 movably attaches strap adjuster 24 to shoulder strap 18 by being movably mounted at one end around the center bar of the strap adjuster by sewing to itself or other means by being flexibly attached at its opposite end to the front of shoulder strap 18 by sewing thereto or other means.

Movably attached to the bottom bar of connector bracket 22 by sewing to itself or other means is connector strap 28 that mounts the right shoulder system to the strumming end of the guitar through strumming tongue 30. This is accomplished by adjustably connecting the opposite end of connector strap 28 through strap adjuster 24(*a*) which passes through connector bracket 22(*a*) which then forms a loop 28(*a*) and is movably attached around the center bar of strap adjuster 24(*a*). Connector bracket 22(*a*) remains movably attached at the lowest position on loop 28(*a*). One end of strumming tongue 30, preferably a leather tongue having a slit opening, is movably connected to the bottom bar of connector bracket 22(*a*) and is releasably mounted to strumming button 2 of the guitar through the slit opening.

Figure 3:
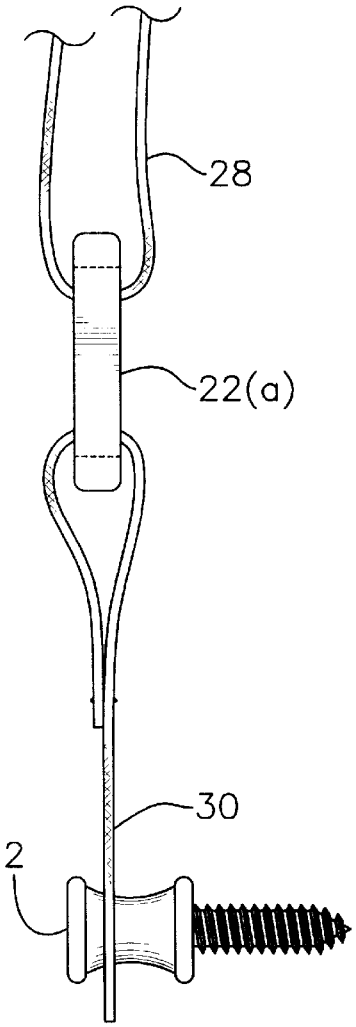
FIG. 3 is a detailed view of a connector braket at the strummuing end.
Figure 4:
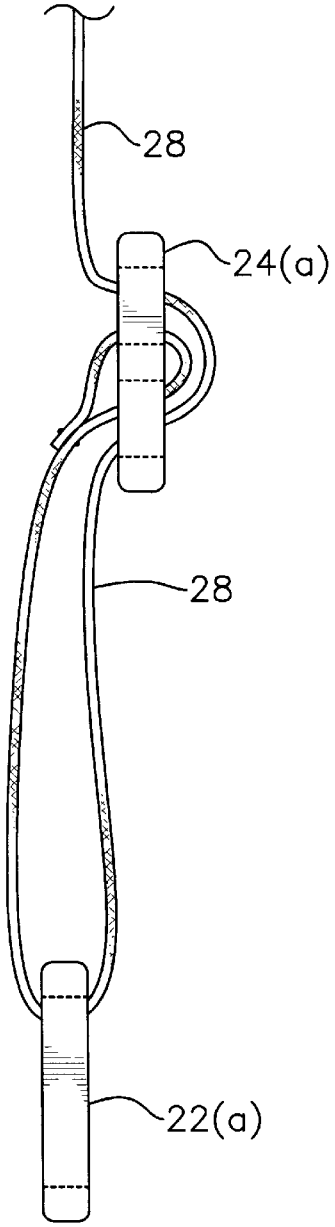
FIG. 4 is a detailed view of a strap adjuster connection.

A preferred connector bracket 22(*a*) is shown in FIG. 3. Generally, it is a double bar rectangular bracket, such as a dee, but can also be a multibar bracket or ring or similar device which movably attaches items at each end of the bracket. A preferred strap adjuster 24(*a*) is shown in FIG. 4. Generally, it is a triple bar rectangular strap adjuster or similar device adjustably mounting the length of one end of the strap through the bars and movably attaching the opposite end of the strap to the middle bar by sewing to itself or other means.

Since connector strap 28 is movably mounted on connector bracket 22, the position of wide shoulder strap 18 will be maintained in position without movement on the top of the shoulder when the weight of the guitar is placed on connector strap 28 due to the following connections. Connector bracket 22 will slide freely within loop 20(*a*) of narrow strap 20 even after making a length adjustment on narrow strap 20. Also, since connector bracket 22(*a*) is movably attached within connector strap loop 28(*a*), connector bracket 22(*a*) will move freely within loop 28(*a*). Further, since strumming tongue 30 is movably mounted to the bottom bar of connector bracket 22(*a*), this position permits adjustment of the length of connector strap 28 while allowing strumming tongue 30 or other connecting device to remain at the lowest position of loop 28(*a*) to be connected to the strumming end of the guitar allowing the weight on the right side to be comfortably positioned on right wide shoulder strap 28.

Left shoulder strap system 14 is seen in FIGS. 1 and 2. Left shoulder wide strap 32 extends over the top of the left shoulder and is held in place by two narrow straps, or other similar straps, attached to the front and rear of shoulder wide strap 32, extending downwardly therefrom, and are clipped into the waste band or belt of the player by suspender mounting means shown in FIG. 5. The two straps, left front narrow strap 34 and left rear narrow strap 36, perform two different functions. Initially, both narrow straps 34 and 36, when at the discretion of the player are positioned towards the outside of the player's left hip, keep wide strap 32 positioned stationary on the outside of the left shoulder. This positioning keeps the the weight of the guitar away from the player's sensitive neck muscles. Secondly, rear narrow strap 36, by being attached to the waste band or belt of the player's pants, supports the weight of the fret end of the guitar. This rear narrow strap positioning prevents wide strap 32 from sliding forward off of the player's left shoulder when the weight of the guitar is applied to the left shoulder strap system.

Figure 5:
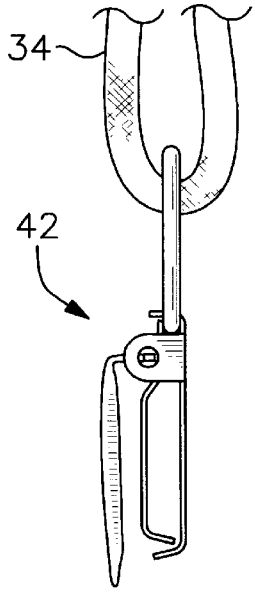
FIG. 5 is a detailed view of a strap loop and suspender clip.

The following procedure is similar for each front narrow strap 34 and rear narrow strap 36 and is treated as one in the following description. One end of each narrow strap is attached to the front or rear, respectively, of shoulder wide strap 32 by sewing or other means. The opposite end of each strap extends downwardly and is adjustably connected in length through strap adjuster 24(*b*) forming suspender connector strap loop 40 and is movably connected to the center bar of strap adjuster 24(*b*) by sewing to itself or other means. Suspension clip 42 as seen in FIGS. 2 and 5 has a double bar bracket element slidably mounted within suspender strap loop 40 of straps 34 and 36 and supporting the clip element movingly mounted downwardly thereon. Suspender clips 42 being slidingly attached within suspender strap loop 40 remain at the lowest position therein after adjustment of length of loop 40 for mounting to the waiste band or belt.

Shown in FIGS. 1 and 2 is the fret end connecting strap system 43 which connects the strap harness to fret end button 3 of the guitar. Fret end strap adjuster 24(*c*) is mounted on left shoulder wide strap 32 by fret end short strap 44 having one end connected to wide strap 32 by sewing or other means and the opposite end movably connected to the middle bar of strap adjuster 24(*c*) by sewing to itself or other means. Fret end strap 46 is adjustably mounted through strap adjuster 24(*c*) extending downwardly therefrom forming fret end strap loop 48. Slidingly attached to strap loop 48 is fret end short connector loop 50 attached to fret end leather tongue 52 which is releasably mounted through slit opening in the tongue on fret end button 3 of the guitar. Since fret end short connector loop 50 resembles a connector bracket by forming the short strap loop attached to itself, and by being slidingly attached to fret end strap loop 48, it allows fret end leather tongue 52 to move to the lowest position in fret end strap loop 48 when adjusted for length. Fret end strap 46 and short connector loop 50 are prepared from soft fabric material to provide more comfort to the player when the guitar is placed against the chest.

Back connector strap strap 16 ties the right and left shoulder strap systems together. One end of back short shoulder strap 54 is connected to right shoulder wide strap 18 by sewing or other means and the opposite end is movingly connected to to the middle bar of back strap adjuster 24(*d*). Rear bridging strap 56 is adjustably connected to strap adjuster 24(*d*) at one end and the opposite end is securely attached to left shoulder wide strap 32 by sewing or other means. The adjustment of the length of bridging strap 56 establishes the location of wide shoulder straps 18 and 32. Once the left wide shoulder strap has been positioned on the shoulder by mounting left front narrow strap 34 and left rear narrow strap 36 to the front and rear of the waist band or player's belt, the adjustment then of the right shoulder wide strap 18 to a comfortable area on the shoulder is an important advantage of the present invention since it is the right shoulder which supports the guitar's strummed end weight.

The following are useful advantageous procedural steps when using the double strap harness 10 of the invention:

Initially, left shoulder wide strap 32 at the fret end of the guitar is located in a comfortable position on the shoulder by moving suspender clips 42 to the outside of the left hip.

Secondly, the length of bridging strap 56 is adjusted to locate right shoulder wide strap 18 on the most comfortable area of the shoulder which supports the heavy weight of the strummed end of the guitar.

Next, the player connects strummed end leather tongue 30 or other connecting device to the strummed end of the guitar, and then connects fret end leather tongue 52 to the fret board end of the guitar.

Lastly, the length of fret end strap 46 connected to short connector loop 50 and leather tongue 52 at the fret end of the guitar is adjusted in length. This adjustment is made in conjunction with similar adjustments made in length of right shoulder connector strap 28 on the strummed end of the guitar. After the correct adjustments, the player will have the guitar positioned at a comfortable angle and also having access to the entire fret board at this time, the two independent shoulder strap systems provide their greatest benefit.

When the player releases the fret end of the guitar from the grip, the greatest amount of weight is evident on the left shoulder at the fret end of the guitar. However during playing, when the fret end of the guitar is lifted higher, the weight then shifts to the strummed end shouder side of the guitar. This permits the player to balance the weight and shift the weight from shoulder to shoulder to prevent fatigue.

A further benefit of the invention is that it allows the player to wear the present strap harness when not in use. This feature allows easy switching among a variety of guitars or other instruments.

The present double strap harness is a very unique system that offers weight distribution techniques not currently available.

Hereinafter, the the strumming end will be referred to as the right end and the fret end will be referred to as the left end.

While the present invention has been described and illustrated with respect to the preferred embodiment, it will be appreciated that variations of the invention may be made without departing from the scope of the invention which is defined in the appending claims.

What is claimed is:

1. A harness for supporting and positioning a guitar in front of a player, said guitar or instrument having mounting attachments at right and left ends, comprising a right shoulder strap system adjustably attachable to the right end mounting attachment of the guitar or instrment, a left shoulder strap system separately adjustably mountable to the front and back of the player, and separately adjustably mountable to the left end mounting attachment of the guitar or instrument, a back connecting strap system adjustably connectable to the right and left shoulder strap systems.

2. The harness according to claim 1 wherein each of the right and left strap systems comprises a shoulder strap element having a front end and a back end extending over the shoulder.

3. The harness according to claim 2 wherein the right shoulder system comprises a looped strap member looped under the right shoulder adjustably connected to the front and back ends of the right shoulder strap element.

4. The harness according to claim 3 wherein a connector strap element having an upper end and lower end is adjustably attached at its upper end to said looped strap member extending downwardly therefrom.

5. The harness according to claim 4 wherein the lower end of said connector strap element comprises an adjustable connector strap loop element.

6. The harness according to claim 5 wherein a right mounting means is slidably attached to said connector strap loop element and is movably attachable to the right end attachment of the guitar or instrument.

7. The harness according to claim 2 wherein the left shoulder strap system comprises a front strap element and a back left shoulder strap element, each having an upper end attached to the front or back end of the left shoulder strap element and a lower end extending downwardly therefrom.

8. The harness according to claim 7 wherein each front and back left shoulder strap element forms an adjustable loop at its lower end.

9. The harness according to claim 8 wherein a suspender clip is movably attached within each left shoulder strap loop and mountable on the player's waist or belt.

10. The harness according to claim 9 wherein a left shoulder looped strap member is adjustably attached to the left shoulder strap member.

11. The harness according to claim 10 wherein a left mounting strap loop member is slidably attached within said left shoulder strap member and is movably mountable on the left end mounting attachment of the guitar or instrument.

12. A harness according to claim 2 wherein the back connecting strap system comprises a bridging strap attached at one end to one shouder strap adjustably attached at an opposite end to the other shoulder strap.

* * * * *